US007757773B2

(12) United States Patent
Rytlewski

(10) Patent No.: US 7,757,773 B2
(45) Date of Patent: Jul. 20, 2010

(54) LATCH ASSEMBLY FOR WELLBORE OPERATIONS

(75) Inventor: Gary Rytlewski, League City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 274 days.

(21) Appl. No.: 11/828,094

(22) Filed: Jul. 25, 2007

(65) Prior Publication Data

US 2009/0025940 A1 Jan. 29, 2009

(51) Int. Cl.
*E21B 29/00* (2006.01)
*E21B 23/00* (2006.01)

(52) U.S. Cl. ..... 166/377; 166/376

(58) Field of Classification Search ..... 166/376, 166/377, 378, 85.1
See application file for complete search history.

(56) References Cited

U.S. PATENT DOCUMENTS 5,709,269 A * 1/1998 Head ..... 166/376
6,464,019 B1 10/2002 Werner
6,880,402 B1 4/2005 Couet
6,883,604 B2 4/2005 Mack
7,255,177 B2 8/2007 Duggan
2004/0043906 A1* 3/2004 Heath et al. ..... 507/200
2004/0188090 A1* 9/2004 Vaeth et al. ..... 166/286
2004/0216887 A1* 11/2004 Bertelsen ..... 166/377
2005/0205265 A1* 9/2005 Todd et al. ..... 166/376
2007/0107908 A1 5/2007 Vaidya
2007/0181224 A1* 8/2007 Marya et al. ..... 148/400

* cited by examiner

*Primary Examiner*—Jennifer H Gay
*Assistant Examiner*—Michael Wills, III
(74) *Attorney, Agent, or Firm*—Rodney V. Warfford; Van Someren, PC

(57) ABSTRACT

A latch for interconnecting a first wellbore element and a second wellbore element in a manner such that the first and second elements can be conveyed into a wellbore in tandem and then disconnected from one another includes a first latch head connectable to the first element, a second latch head connectable to the second element, and a lock mechanism connectable between the first and second latch heads, wherein the lock mechanism structurally degrades when exposed to the wellbore environment allowing disconnection of the first latch head and the second latch head.

19 Claims, 2 Drawing Sheets

LATCH ASSEMBLY FOR WELLBORE OPERATIONS

FIELD OF THE INVENTION

The present invention relates in general to wellbore or borehole operations and more particularly to latching systems for running interconnected elements into a wellbore in tandem and facilitating later disconnection of the elements from one another.

BACKGROUND

Latch assemblies are often utilized in wellbore operations so that one member may be stabbed into another member for connection and later disconnected. For example, a snap latch is used to interconnect a tubing string to a packer disposed in a wellbore. To connect the tubing string to the packer, a first amount of weight is applied to the latch. For disconnection a second amount of weight in tension is required to disconnect the connection.

There has been an unresolved need for a latch assembly or connection that will allow for running elements into a well in tandem, i.e. in a single trip, and allow for ease of disconnection of the elements at a later time. Snap-type connections have not addressed this need due to their inability to carry weight exceeding their disconnect weight.

SUMMARY OF THE INVENTION

A latch for interconnecting a first wellbore element and a second wellbore element in a manner such that the first and second elements can be conveyed into a wellbore in tandem and then disconnected from one another includes a first latch head connectable to the first element, a second latch head connectable to the second element, and a lock mechanism connectable between the first and second latch heads, wherein the lock mechanism structurally degrades when exposed to the wellbore environment allowing disconnection of the first latch head and the second latch head. Once the lock mechanism degrades sufficiently the latch may be disconnected by applying tension to the latch, without requiring rotation of the latch.

Examples of materials of construction of the lock mechanism include a combination of a normally insoluble metal or alloy with one or more elements selected from a second metal or alloy, a semi-metallic material, and non-metallic materials; and one or more solubility-modified high strength and/or high-toughness polymeric materials selected from polyamides, polyethers, and liquid crystal polymers.

In one example, the lock mechanism is constructed of a material comprising a combination of a normally insoluble metal selected from iron, copper, titanium, zirconium, and an element selected from germanium, silicon, selenium, tellurium, polonium, arsenic, antimony, phosphorus, boron, and carbon.

A method of conducting wellbore operations includes the steps of making up a work string having a lower completion connected to an upper completion by a latch assembly having a first latch head connected to a second latch head; positioning a degradable lock mechanism to secure the first and second latch heads together; running the work string into the wellbore in a single trip; degrading the lock mechanism such that it does not secure the latch head together; and detaching the first latch head from the second latch head.

The foregoing has outlined the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
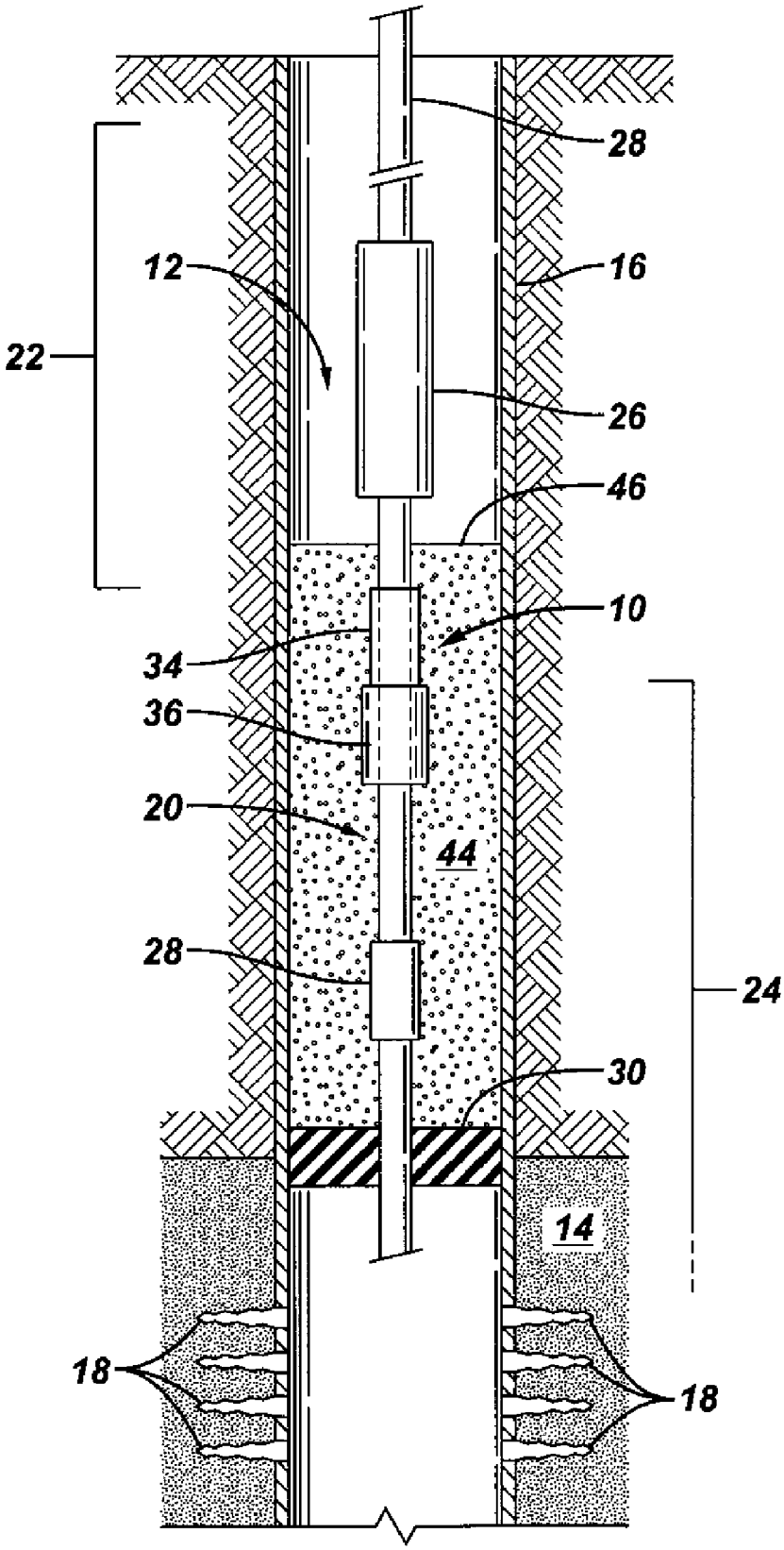
FIG. 1 is a wellbore schematic illustrating a latch assembly of the present invention in operation.

Refer now to the drawings wherein depicted elements are not necessarily shown to scale and wherein like or similar elements are designated by the same reference numeral through the several views.

As used herein, the terms "up" and "down"; "upper" and "lower"; and other like terms indicating relative positions to a given point or element are utilized to more clearly describe some elements of the embodiments of the invention. Commonly, these terms relate to a reference point as the surface from which drilling operations are initiated as being the top point and the total depth of the well being the lowest point. As is recognized in the art, the wellbore and portions of the wellbore may be oriented from vertical, perpendicular to the earth's surface, to horizontal, parallel to the earth's surface.

Refer now to FIG. 1 wherein a latch assembly of the present invention, generally denoted by the numeral 10, is illustrated in use in a wellbore or borehole 12. Wellbore 12 is drilled into the earth to encounter one or more selected subterranean formations 14. Wellbore 12 may be completed with casing 16. Casing 16 has perforations 18 proximate to formation 14 to facilitate the flow between wellbore 12 and formation 14.

Latch assembly 10 is connected within a work string, generally denoted by the numeral 20. Work string 20 includes an upper portion 22, also referred to from time to time as the upper completion, and a lower portion 24, also referred to from time to time as the lower completion. Upper completion 22 and lower completion 24 are releasably, interconnected by latch assembly 10.

Work string 20 may be configured in numerous manners to carry or interconnect multiple elements and/or individual wellbore tools and/or sensors. For example, in a simple configuration the work string may comprise a tubing string carrying a packer, the latch assembly providing a mechanism for disconnecting from the packer. Latch assembly 10 of the present invention is particularly adapted for work strings carrying a significant weight below latch assembly 10. For example, where the weight of the lower completion exceeds the weight of a desirable limit for the overpull to unlatch or disconnect a conventional latch assembly.

Work string 20 illustrated in FIG. 1 includes an electric submersible pump (ESP) 26 carried by a conveyance 28 such as a tubing string. ESP 26 and conveyance 28 comprise the upper completion 22. In the illustrated configuration, lower completion 24 includes a formation isolation valve 30, a hydraulic packer 32 and additional tubing 28. It is noted that work string 20 may include more or fewer elements than are illustrated.

Latch assembly 10 of the present invention provides a mechanism for running the upper and lower completions 22, 24 into wellbore 12 in a single trip and the ability to unlatch the elements at a later time. This is a significant improvement to prior methods for completing wellbores with an ESP 26, wherein the weight of the lower completion cannot be carried by a convention snap-type latch without disconnecting.

It is typically required to remove the ESP from the wellbore periodically for maintenance, repair or replacement. Thus, it is necessary to release the upper completion carrying the ESP from the lower completion to remove the ESP from the well. This reality affects the manner in which ESP completions are installed. In a common ESP completion, the lower completion carries significant weight. Therefore, the lower completion is run into the well and set and then the tubing is pulled out of the well. The upper completion carrying the ESP is then run into the well and connected to the lower completion. The upper completion and lower completion are commonly connected with a snap latch assembly for disconnection of the completions at a later date. The disconnection or unlatch of snap latch type assemblies is achieved by applying tension or overpull (tension greater than the lower weight) to the latch assembly. The present invention provides a mechanism for running a heavy lower completion with an upper completion into a well and providing the ability to disconnect the upper completion from the lower completion by applying tension to the work string.

Figure 2:
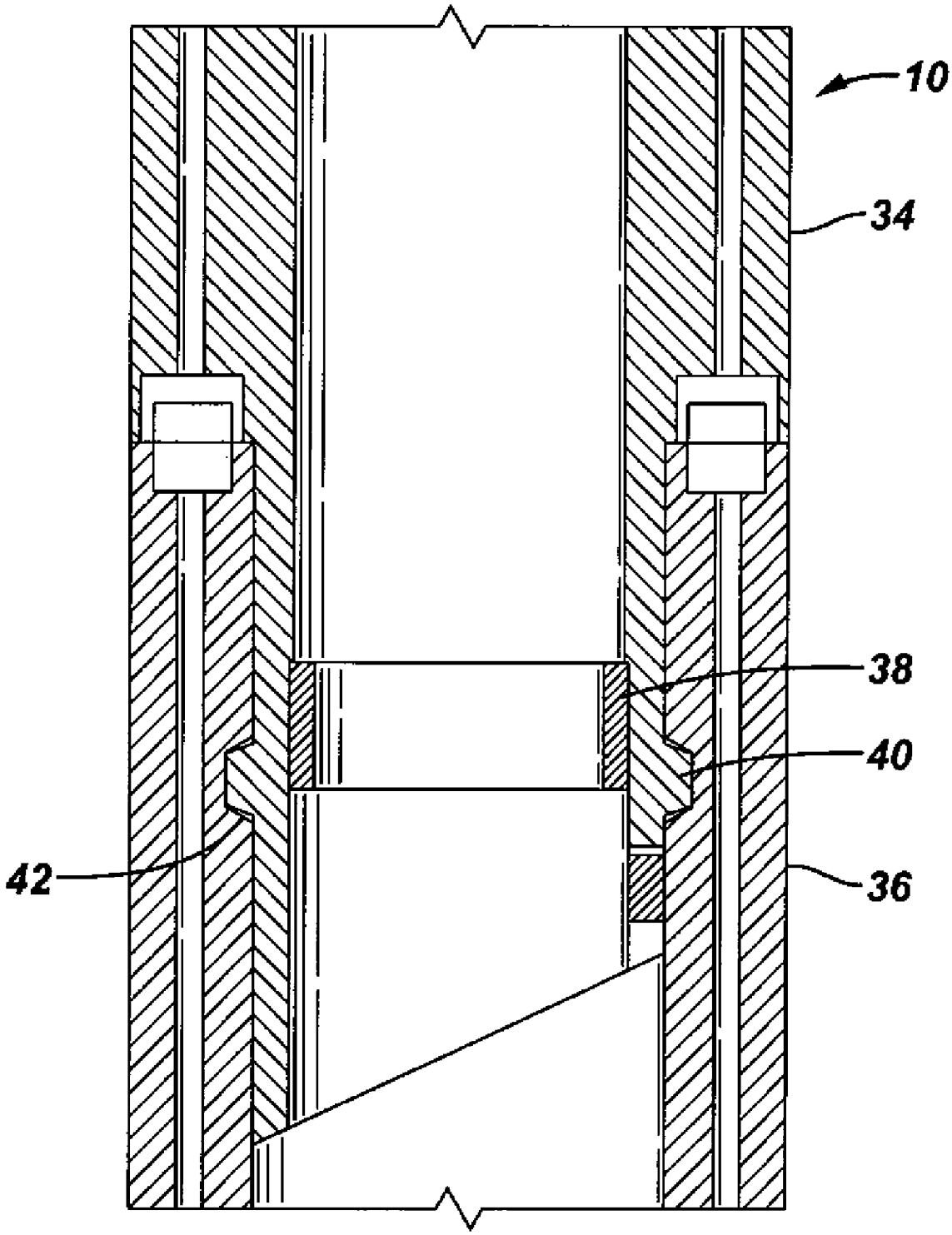
FIG. 2 is a cross-sectional view of an example of a latch assembly of the present invention.

Refer now to FIG. 2 wherein a configuration of a latch assembly 10 of the present invention is illustrated. Latch assembly 10 includes a first latch head 34, a second latch head 36, and a lock member 38. First latch head 34 includes an upset 40 adapted for seating in recess 42 formed by second latch head 36. First and second latch heads 34, 36 form a collet-type snap latch assembly. Lock member 38 is a dissolvable member that is positioned within first latch head 34 urging and maintaining first and second latch heads 34, 36 in connection. It is noted that the second latch head may be a polished bore receptacle or other device adapted for seating and connecting the first latch head.

A method of use of latch assembly 10 is now described with reference to FIGS. 1 and 2. Latch assembly 10 is made-up in the locked position, shown in FIG. 2, with lock mechanism 38 maintaining first latch head 34 in engagement with second latch head 36. As work string 20 is made-up and run into wellbore 12, latch head 36 is connected with the lower completion 24 and latch head 34 is connected with upper completion 22. Work string 20 is continually made-up and run into the well until the completion is set. Once work string 20 is positioned within wellbore 12, latch assembly will have been in contact with water in aqueous solution 44. In ESP completions as shown in FIG. 1, latch assembly 10 will be positioned below the surface 46 of aqueous solution 44. Upon sufficient contact with aqueous solution 44, lock member 38 will degrade sufficiently so as to not urge or maintain latch heads 34 and 36 in engagement with one another. In some configurations of lock mechanism 38 it may substantially dissolve when contacted with fluid 44. Once lock mechanism 38 degrades, latch heads 34 and 36 remain in the latched position such as with a convention snap latch assembly. Thus, when it is desired to unlatch a sufficient tension, or over pull, is applied to conveyance 28 disengaging latch head 34 from latch head 36.

Lock mechanism 38 is constructed of material such that it dissolves or degrades in the wellbore to a degree that it no longer maintains latch heads 34, 36 in locked engagement. Thus, latch assembly 10 can be disconnected by the application of tension via conveyance 28. Lock mechanism 38 is constructed so as to maintain its structural integrity for a period of time sufficient to run and set the work string and or completions in the wellbore. The dissolution or degradations of lock mechanism 38 is initiated by contact with the wellbore fluids or aqueous conditions. As used herein the term "aqueous conditions" includes not only water but water-based such as drilling muds, and includes mildly acidic and mildly alkaline conditions (pH ranging from about 5 to about 9), although this range is very general, and in particular sections of a wellbore the pH may be less than 5 or greater than 9 at any given moment in time.

Lock mechanism 38 may be constructed of various materials or compositions, including the examples identified in the United States Patent Application Publications 2007/0044958 and 2007/0107908 which are incorporated in their entirety herein.

In one example, lock mechanism 38 is constructed of a first type of material comprising a combination of a normally insoluble metal or alloy with one or more elements selected from a second metal or alloy (e.g., a compacted powder blend of magnesium with a stainless steel), a semi-metallic material (e.g., a sintered blend of powders of magnesium with silicon or carbon, e.g., graphite), and a non-metallic material (e.g. an acid producing polymer, or a metal-based soluble ionic compound such as alkaline and alkaline earth oxides, carbonates, sulfides, and the like). As used herein the term "normally insoluble" means the metal does not substantially or significantly degrade or deteriorate, whether by oxidation, hydrogen embrittlement, galvanic corrosion or other mechanism, in the time frame during which the lock mechanism is intended to maintain the latch heads in an engaged and locked position preventing disengagement by tension on conveyance 28. When the second material or combination of materials is combined with the normally insoluble metal a water-soluble third phase is formed.

Lock mechanism 38 may be structured in many ways to control its structural degradation under aqueous conditions, if desired. For example, a normally insoluble metal may comprise a coating, covering, or sheath upon a portion of or an entire outer surface of the lock mechanism, or the normally insoluble metal may be embedded into a mass of the one or more elements selected from a second metal or alloy, a semi-metallic material, and non-metallic materials (and more water-soluble) phase.

The first type of material or composition comprises a combination of normally insoluble metal or alloys with metallurgically-soluble (partially/wholly) and/or blendable elements selected from other metals or alloys, semi-metallic elements, and/or non-metallic elements. The composition forms a structure of poor stability in the designated wellbore fluid environment. Examples of metals preferentially selected to develop high strength include iron, titanium, copper, zirconium, combinations of these, and the like, among other metals. Second metals (including reactive metals), semi-metallic elements, and non-metallic elements are any metal, semi-metallic element, or non-metallic element that will form a non-durable (degradable) composition with the first element. Examples include metals such as calcium, gallium, indium, tin, antimony, manganese, tungsten, molybdenum, chromium, combinations of these, and the like; semi-metallic elements such as germanium, silicon, selenium, tellurium, polonium, arsenic, antimony, phosphorus, boron, carbon, and carboxylated carbon (e.g. in graphitic or nanotube form), and organic compounds such as sulfonated polystyrene, styrene sulfonic acid; and compositions comprising non-metallic materials such as oxides (anhydride), carbonates, sulfides, chlorides, bromides, acid-producing or basic producing polymers, or in general fluid pH changing polymers. Many of these non-metallic materials may contain metals that are chemically-bonded to non-metallic elements (wherein the bonds may be ionic, covalent, or any degree thereof). These materials include, but are not limited to, alkaline and alkaline-earth oxides, sulfides, chlorides, bromides, and the like. These materials, alone, are at least partially water-soluble and, when properly combined (e.g. blended) with normally insoluble metals and alloys, will degrade the chemical resistance of the normally insoluble metals by changing the designated fluid chemistry, including its corrosiveness, thus creating galvanic cells, among other possible mechanisms of degradations. Examples of normally insoluble metals and alloys made soluble through the additions of elements, including polymers that directly destabilize the metallic state of the normally insoluble element for a soluble ionic state (e.g. galvanic corrosion, lower pH created by acid-polymers), or indirectly by promoting ionic compounds such as hydroxides, known to predictably dissolve in the designated fluid environment. Also included in the invention are exothermic reactions occurring in fluid such as water that may act as trigger to the degradation of one of the composition.

In another example, lock mechanism 38 may be constructed of a second type of material or composition. The second type of material of construction of lock mechanism 38 includes one or more solubility-modified high strength and/or high-toughness polymeric materials that may be selected from polyamides (including but not limited to aromatic polyamides), polyethers, and liquid crystal polymers. As used herein, the term "polyamide" denotes a macromolecule containing a plurality of amide groups. Polyamides as a class of polymer are well known in the chemical arts, and are commonly prepared via a condensation polymerization process whereby diamines are reacted with dicarboxylic acid (diacids). Copolymers of polyamides and polyethers may also be used, and may be prepared by reacting diamines with diacids.

As used herein the term "high-strength and/or high-toughness" means simply that the solubility-modified polymer has physical strength to maintain latch assembly 10 in the locked position when running in the wellbore to perform its intended function. As used herein the term "solubility-modified" means that the high-strength and/or high-toughness polymeric materials are normally insoluble in aqueous conditions, but are chemically, physically, and/or mechanically modified to be soluble in aqueous conditions.

Lock mechanism 38 may be structured so that the chemically, physically and/or mechanically modified portions of the solubility-modified high-strength and/or high-toughness polymeric materials may be sequestered away from contacting water or water-based fluids. The solubility-modified high-strength and/or high-toughness polymers may include acidic ingredients, alkaline ingredients, fillers, mechanical reinforcing materials, and the like, in order to alter the rate of dissolution and/or alter mechanical properties of lock mechanism 38 based on modified polymeric materials. The solubility-modified high-strength and/or high-toughness polymeric materials may comprise blends of two or more solubility-modified high-strength and/or high-toughness polymers, and blends of one or more solubility-modified high-strength and/or high-toughness polymers and one or more other polymers unlimited in type (thermoset, and non-thermoset polymeric materials). The solubility modified high strength and/or high-toughness polymeric materials may also contain blends of one or more solubility-modified high strength polymers and nonpolymeric hydrophilic materials, such as fumed silica, functionalized fillers such as carboxyl functionalized carbon nanotubes, hydrophilic nanoclays, and the like, as well as soluble and/or reactive metals such as calcium and calcium salt.

The rate of solubility of the solubility-modified high strength and/or high-toughness polymeric material may be modified by blending the solubility-modified high strength and/or high-toughness polymeric material with a high barrier property filler, for example nanoclays like bentonite, expanded graphite, and other high aspect ratio platy fillers such as mica and talc. The term "polymeric material" includes composite polymeric materials, such as, but not limited to, polymeric materials having fillers, plasticizers, and fibers therein. Suitable synthetic polymeric materials include those selected from thermoset polymers and non-thermoset polymers. Examples of suitable non-thermoset polymers include thermoplastic polymers, such as polyolefins, polytetrafluoroethylene, polychlorotrifluoroethylene, and thermoplastic elastomers.

Referring back to FIGS. 1 and 2, lock mechanism 38 for example has a tensile strength that may be no less than about 4000 psi (28 mPa), or a minimum strain energy per unit volume of 2,500 in-ob/cu. in. (17 joules/cc). In the illustrated example, lower completion 24 has a weight of 200,000 pounds (440,000 kg) which is supported by latch assembly 10 facilitating running the upper and lower completions in tandem. However, upon degradation of lock member 38 the latch heads can be disengaged by applying between 10,000 to 50,000 pounds (22,000 to 110,000 kg) of tension to latch assembly 10.

From the foregoing detailed description of specific embodiments of the invention, it should be apparent that a system for running multiple elements into a wellbore in a single trip for later disconnection from one another with overpull that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A latch for interconnecting a first wellbore element and a second wellbore element in a manner such that the first and second elements can be conveyed into a wellbore in tandem and then disconnected from one another, the latch comprising:

a first latch head connectable to the first element;

a second latch head connectable to the second element, the first latch head being received in the second latch head until latched via a corresponding upset and recess; and a lock mechanism disposed within the first latch head to resist radially inward movement of the first latch head, thus maintaining the corresponding upset and recess in secure engagement, wherein the lock mechanism structurally degrades when exposed to the wellbore environment allowing disengagement of the corresponding upset and recess and thus disconnection of the first latch head and the second latch head.

2. The latch of claim 1, wherein the lock mechanism is water soluble.

3. The latch of claim 1, wherein the first latch head and the second latch head are disconnectable by applying a specified tension once the lock mechanism has degraded.

4. The latch of claim 1, wherein lock mechanism is formed of a combination of a powder blend of magnesium with a stainless steel.

5. The latch of claim 1, wherein the lock mechanism is constructed of a combination of a normally insoluble metal or alloy with one or more elements selected from a second metal or alloy, a semi-metallic material, and non-metallic materials.

6. The latch of claim 5, wherein the combination of the normally insoluble metal or alloy and the one or more selected elements forms a water-soluble material.

7. The latch of claim 5, wherein the normally insoluble metal selected from iron and titanium.

8. The latch of claim 1, wherein the lock mechanism is constructed of a combination of a normally insoluble metal and a second metal to form a water-soluble material.

9. The latch of claim 8, wherein the normally insoluble metal is selected from the group consisting of iron, copper, titanium, zirconium, and combinations thereof.

10. The latch of claim 8, wherein the second metal is selected from the group consisting of calcium, manganese, tungsten, molybdenum, chromium, and combinations thereof.

11. The latch of claim 9, wherein the second metal is selected from the group consisting of calcium, manganese, tungsten, molybdenum, chromium, and combinations thereof.

12. The latch of claim 1, wherein the lock mechanism is constructed of a material that includes one or more solubility-modified high strength and/or high-toughness polymeric materials that are selected from polyamides, polyethers, and liquid crystal polymers.

13. The latch of claim 12, wherein the polyamide is an aromatic polyamide.

14. A latch for interconnecting a first wellbore element and a second wellbore element in a manner such that the first and second elements can be conveyed into a wellbore in tandem and then disconnected from one another by applying tension to the latch, the latch comprising:

a first latch head connectable to a second latch head; and a lock mechanism positioned to lock the first and second latch heads together until the lock mechanism structurally degrades in the wellbore, the lock mechanism being a ring positioned within the first latch head to prevent radially inward movement of the first latch head, wherein the ring structurally degrades when reacted with fluid in the wellbore to allow radially inward movement of the first latch head which enables disengagement and thus disconnection of the first latch head and the second latch head.

15. A method of conducting wellbore operations, the method comprising:

making up a work string having a lower completion connected to an upper completion by a latch assembly having a first latch head connected to a second latch head;

positioning a degradable lock mechanism to secure the first and second latch heads together by temporarily preventing radial inward deflection of the first latch head with respect to the second latch head;

running the work string into the wellbore in a single trip;

degrading the lock mechanism such that it does not secure the latch heads together, wherein degrading includes reacting the lock mechanism material with fluid in the wellbore; and detaching the first latch head from the second latch head.

16. The method of claim 15, wherein the lock mechanism is constructed of a material selected from:

a combination of an insoluble metal or alloy with one or more elements selected from a second metal or alloy, a semi-metallic material, and non-metallic materials; and one or more solubility-modified high strength and/or high-toughness polymeric materials selected from polyamides, polyethers, and liquid crystal polymers.

17. The method of claim 15, wherein the lock mechanism is constructed of a material comprising a combination of a calcium and an insoluble metal selected from iron, copper, titanium, zirconium.

18. The method of claim 15, wherein the lock mechanism comprises a polymeric material.

19. The method of claim 15, wherein the lock mechanism includes a metal reactive in water.

* * * * *